US007279828B2

(12) United States Patent
Jang et al.

(10) Patent No.: US 7,279,828 B2
(45) Date of Patent: Oct. 9, 2007

(54) GLASS PANEL AND A CATHODE RAY TUBE INCLUDING THE SAME

(75) Inventors: Gue Chul Jang, Kyungki-do (KR); Jae Seon Kim, Kyungki-do (KR); Hyo Keun Lee, Kyungki-do (KR)

(73) Assignee: Samsung Corning Co., Ltd., Kyungki-Do (KR)

( * ) Notice: Subject to any disclaimer, the term of this patent is extended or adjusted under 35 U.S.C. 154(b) by 162 days.

(21) Appl. No.: 11/170,142

(22) Filed: Jun. 30, 2005

(65) Prior Publication Data

US 2006/0001351 A1 Jan. 5, 2006

(30) Foreign Application Priority Data

Jul. 2, 2004 (KR) ..... 10-2004-0051478

(51) Int. Cl.
*H01J 29/86* (2006.01)

(52) U.S. Cl. ..... 313/477 R; 313/461; 220/2.1 A

(58) Field of Classification Search ..... None
See application file for complete search history.

(56) References Cited

U.S. PATENT DOCUMENTS 5,964,364 A * 10/1999 Shimizu et al. ..... 220/2.1 A
6,566,802 B1 * 5/2003 Jeong ..... 313/477 R
7,026,752 B2 * 4/2006 Kyono et al. ..... 313/477 R
7,088,035 B2 * 8/2006 Sugawara et al. ..... 313/480

* cited by examiner

*Primary Examiner*—Ashok Patel
(74) *Attorney, Agent, or Firm*—Bacon & Thomas PLLC

(57) ABSTRACT

A glass panel for use in a cathode ray tube includes a face portion for displaying images; a skirt portion extending from a periphery of the face portion backwards; and a blend radius portion for connecting the face portion and the skirt portion. The face portion is provided with an effective screen and a wedge portion positioned near a periphery portion of the effective screen. Compressive stress layers are formed on any regions of an inside and an outside surface of the face portion and the skirt portion, and a maximum compressive stress value σFmax of the face portion and a minimum compressive stress value σSmin of the skirt portion satisfy a relationship of σSmin/σFmax<0.5.

4 Claims, 1 Drawing Sheet

GLASS PANEL AND A CATHODE RAY TUBE INCLUDING THE SAME

FIELD OF THE INVENTION

The present invention relates to a glass panel for use in a cathode ray tube and a cathode ray tube including the same; and, more particularly, to a glass panel which is capable of being strengthened with relatively reduced deformation of its face portion that occurs during a panel manufacturing process, and a cathode ray tube including the same.

BACKGROUND OF THE INVENTION

In general, along with the trend toward the flattening of picture planes of a television set and a monitor, there has been the increased necessity for ensuring mechanical safety of a glass panel for use in a cathode ray tube (hereinafter referred to as CRT) and a CRT including the same. So the glass panel for use in a CRT is usually subjected to a physical strengthening process to improve its mechanical strength by increasing compressive stresses on an inside and outside surface thereof.

In the aforementioned physical strengthening process, when glass is quickly cooled down from a high temperature near the softening point, the surface thereof becomes contracted and solidified, whereas an inner portion thereof still remains in an expanded state (or liquid state) while having sufficient liquidity. As a result, when the temperature of the glass drops to room temperature and reaches a sufficient equilibrium state, a great compressive stress layer is generated on the surfaces of the glass and a tensile stress layer is generated in the inner portion thereof, which results in residual stresses. The intensity of the stresses depends on length of time required for the temperature of the glass surface to drop from the annealing point to the strain point. If the cooling of the glass is carried out quickly, contraction differences between the surface and inner portion of the glass become great and, further, great compressive stresses are generated on the glass surface after the cooling has been completed.

In the physically strengthened panel, the local tensile stress concentration occurs in the inside surface of its corner portion and like. That is, non-uniform stress distribution over the glass panel for use in a CRT occurs, which leads to its deformation.

The following is a description of a conventional physical strengthening process for improving a mechanical strength of a glass panel.

First, a lump of molten glass is press-formed in a mold to make a glass panel to be subjected to the physical strengthening process. Next, cooling air is applied to the press-formed glass panel and, then, the press-formed glass panel is removed from the mold. The removed glass panel is subjected to a stud pin installing process while being naturally cooled down. At this time, residual stresses of hundreds of MPa are generated on the glass panel by the natural cooling. The glass panel with such great residual stresses is very brittle and, thus, the intensity of the residual stresses, which has been generated on the glass panel by the natural cooling, needs to be reduced. Accordingly, the glass panel is reheated in an annealing lehr and maintained below the annealing point for a predetermined period of time, so that the residual stresses generated on the glass panel can be relaxed. At this time, in general, before the glass penal is inputted into the annealing lehr, temperature of most area on the glass panel is dropped below the strain point.

In case the intensity of the residual stresses generated on the glass panel is controlled, as described above, by reheating the panel in the annealing lehr to a temperature below the annealing point and then cooling down the reheated glass panel to room temperature, sizes of the glass panel are changed.

That is, in the conventional physical strengthening process for the glass panel, the skirt portion of the glass panel is cooled down more quickly than the face portion thereof after the glass panel is press formed and before it is inputted into the annealing lehr, so that the intensity of the residual stresses of the skirt portion becomes greater than those of the face portion. Therefore, in the conventional physical strengthening process of the glass panel, the skirt portion, which is cooled down and solidified more quickly than the face portion, is deformed due to its cooling and solidification, and this causes relatively great deformation in the face portion still having viscous liquidity. As a result, the face portion deformation changes an inside surface curvature of the face portion, which leads to inferior characteristics of a screen (or picture) portion of a cathode ray tube.

SUMMARY OF THE INVENTION

It is, therefore, a primary object of the present invention to provide a glass panel for use in a CRT, which is capable of improving characteristics of a screen portion of a cathode ray tube owing to relatively reduced deformation of a face portion thereof that occurs during a physical strengthening process of the glass panel.

It is another object of the present invention to provide a cathode ray tube including the aforementioned glass panel for use in a CRT.

In accordance with a preferred embodiment of the present invention, there is provided a glass panel for use in a cathode ray tube, including: a face portion for displaying images; a skirt portion extending from a periphery of the face portion backwards; and a blend radius portion for connecting the face portion and the skirt portion, wherein the face portion is provided with an effective screen and a wedge portion positioned near a periphery portion of the effective screen, and compressive stress layers are formed on any regions of an inside and an outside surface of the face portion and the skirt portion, and a maximum compressive stress value $\sigma Fmax$ of the face portion and a minimum compressive stress value $\sigma Smin$ of the skirt portion satisfy a relationship of $\sigma Smin/\sigma Fmax<0.5$.

In accordance with another preferred embodiment of the present invention, there is provided a cathode ray tube including the glass panel for use in a CRT of the preferred embodiment of the present invention.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENT

Hereinafter, preferred embodiments of the present invention will be described with reference to FIGS. 1 and 2.

Figure 1:
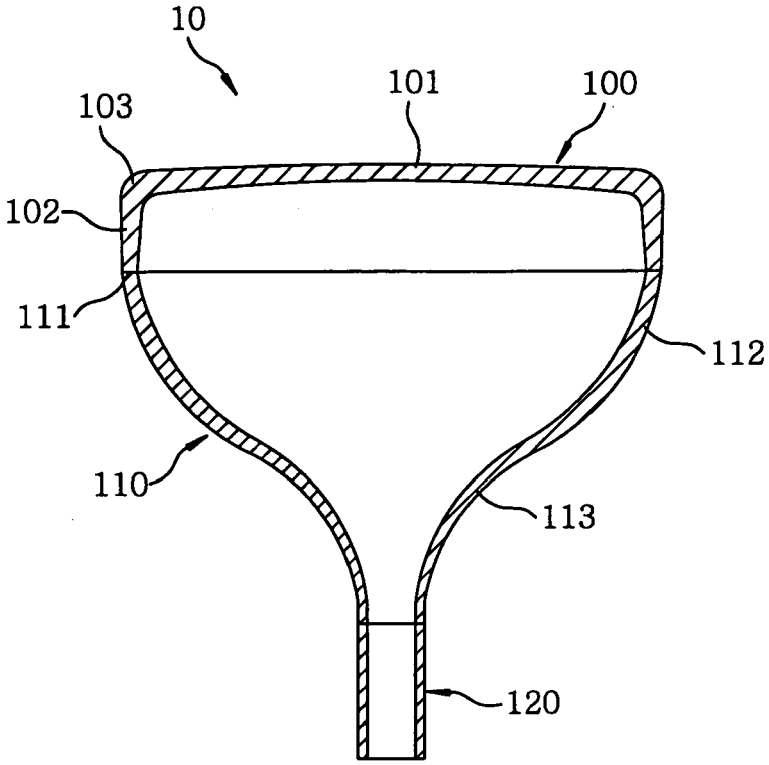
FIG. 1 shows a cross-sectional view of a cathode ray tube in accordance with a first preferred embodiment of the present invention.

Referring to FIG. 1, there is shown a cross-sectional view of a cathode ray tube in accordance with a first preferred embodiment of the present invention. As illustrated in FIG. 1, the cathode ray tube 10 in accordance with the first preferred embodiment of the present invention includes a glass panel 100 for use in a CRT, which is for displaying picture images; a conical funnel 110 connected to a backside of the panel 100; and a cylindrical neck 120 connected to a rear end of the funnel 110.

Herein, the funnel 110 includes a body part 112 and a yoke part 113 extending from a rear end of the body part 112. The body part 112 is connected to the glass panel 100 at a seal edge 111, and the yoke part 113 is connected to the neck 120.

Further, the glass panel 100 for use in a CRT includes a face portion 101 whose inside surface is coated with an image-forming fluorescent material for displaying picture images; a skirt portion 102 which extends from a periphery of the face portion 101 backwards and is connected to the funnel 110; and a blend radius portion 103 for connecting the face portion 101 and the skirt portion 102.

Furthermore, the neck 120 is provided with an electron gun (not shown).

The panel 100, the funnel 110 and the neck 120 are formed of glass, wherein particularly the panel 100 and the funnel 110 can be formed of desired dimensions and shapes by press forming a lump of molten glass, a glass gob in a mold (not shown). An inside surface of the press-formed glass panel 100 is subjected to a cooling process by cooling air and, then, the press-formed glass panel 100 is removed from the mold. Next, the removed panel 100 undergoes a stud pin installing process while being naturally cooled down.

In order to relax the residual stresses generated on the glass panel 100 by the natural cooling, the panel 100 is reheated in the annealing lehr and then kept at temperature below the annealing point for a predetermined length of time. Thereafter, the glass panel 100 is cooled down to room temperature, thereby enabling to relax the residual stresses generated on the glass panel 100. The intensity of the residual stresses can be changed by controlling the length of time during which the glass panel 100 is kept in the annealing lehr, and temperature of the annealing lehr.

In the physical strengthening process for manufacturing the glass panel 100 for use in a CRT in accordance with a second preferred embodiment of the present invention, the temperature of the annealing lehr and the length of time during which the glass panel 100 is kept in the annealing lehr can be changed according to types and sizes of the glass panel 100, a working environment, required final residual stresses or the like.

Figure 2:
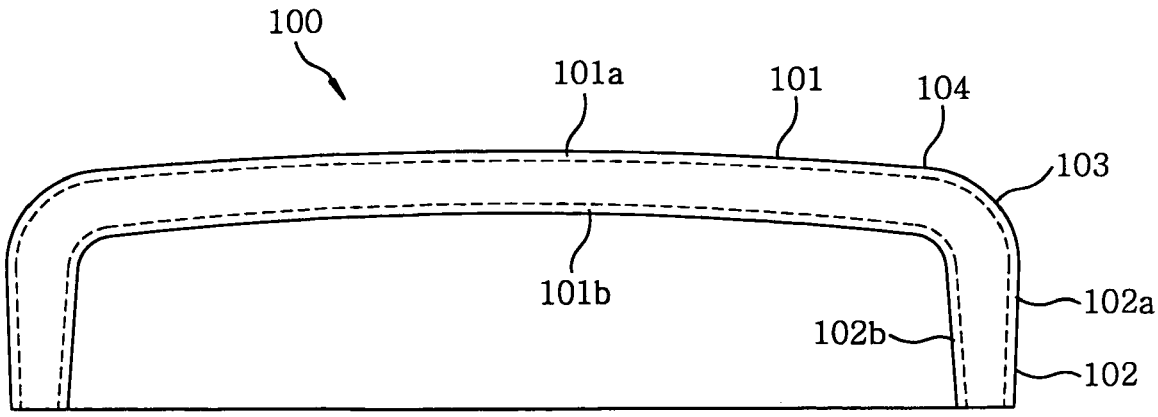
FIG. 2 describes a cross-sectional view of a physically strengthened glass panel for use in a CRT in accordance with a second preferred embodiment of the present invention.

Referring to FIG. 2, there is described a cross-sectional view of a physically strengthened glass panel for use in a CRT in accordance with the second preferred embodiment of the present invention.

As shown in FIG. 2, the glass panel 100 in accordance with the second preferred embodiment of the present invention includes the face portion 101, the skirt portion 102 and a blend radius portion 103 for connecting the face portion 101 and the skirt portion 102. A reference notation 104 represents a wedge portion, i.e., a portion positioned about 1 inch away from a periphery of an effective screen of the face portion 101 toward a center of the face portion 101.

By the physical strengthening process for the glass panel 100 in accordance with the second preferred embodiment of the present invention, an inside surface compressive stress layer 101*b* and an outside surface compressive stress layer 101*a* are formed on an inside and outside surface of the face portion 101 of the glass panel 100, respectively. Further, an inside surface compressive stress layer 102*b* and an outside surface compressive stress layer 102*a* are formed on an inside and outside surface of the skirt portion 102, respectively. Thicknesses of these compressive stress layers 101*a*, 101*b*, 102*a* and 102*b* are preferably equal to or greater than 1/10 of thickness of the glass panel 100 but less than or equal to 3/10 thereof. If the thicknesses of the compressive stress layers 101*a*, 101*b*, 102*a* and 102*b* are less than 1/10 of the thickness of the panel 100, the level of the physical strengthening is low and, thus, low-level surface compressive stresses are generated on the surfaces of the glass panel 100. In such a case, various surface defects, which have been generated on such panel in manufacturing and using a cathode ray tube, can cause problems concerning the strength of the cathode ray tube and the life span thereof can be shortened. Moreover, the current available manufacturing technology is impossible to form surface compressive stress layer having thickness greater than 3/10 of the thickness of the panel 100. However, the present invention is not limited to such numerical values but can be applied to glass panels which have surface compressive stress layers thicker than 3/10 of their thicknesses through development of the physical strengthening technology.

In addition, in the second preferred embodiment of the present invention, by cooling down the face portion 101 of the glass panel 100 more quickly than the skirt portion 102, surface compressive stresses generated on the face portion 101 are greater than those generated on the skirt portion 102. Accordingly, the deformation of the face portion 101, which is caused by the contraction and solidification of the skirt portion 102, can be relatively reduced. As a result, the accuracy of the inside surface curvatures of the face portion 101 can be improved.

In order to cool down the face portion 101 of the panel 100 more quickly than the skirt portion 102, it is necessary to increase a heat extraction rate from the mold in which the press-formed glass panel 100 is positioned. That is, the mold is cooled down by making various coolants flow in its interior, and, further, heat is extracted from the glass panel 100 to the outside by heat transfer. Besides, by applying the cooling air to the face portion 101 of the glass panel 100 removed form the mold, the cooling rate of the face portion 101 can be increased compared to that of the skirt portion 102, thereby enabling to cool down the face portion 101 more quickly than the skirt portion 102.

More preferably, the maximum compressive stress value $\sigma Fmax$ of the face portion 101 and the minimum compressive stress value $\sigma Smax$ of the skirt portion 102 satisfy the relationship of $\sigma Smax/\sigma Fmax \leqq 0.5$. When the relationship of $\sigma Smax/\sigma Fmax \leqq 0.5$ is satisfied, the deformation of the face portion 101 can be relatively reduced. On the contrary, the satisfaction of the relationship of $\sigma Smax/\sigma Fmax > 0.5$ means that the cooling of the skirt portion is carried out too quickly. In this case, the supercooling of the skirt portion can cause a breakage of the panel when the panel is in the mold or removed therefrom and, further, an appropriate periphery of the seal edge 111 sealingly connected to the funnel 110 cannot be ensured, wherein the periphery quality is one of important guidelines since poor seal edge quality can directly lead to an exhaust implosion.

In order to maintain a ratio of the minimum compressive stress value σSmax of the skirt portion 102 to the maximum compressive stress value σFmax of the face portion 101 less than or equal to 0.5, an apparatus or facility for manufacturing a glass panel for a CRT is designed in such a manner that a flow rate of the cooling air to be applied to the skirt portion 102 is relatively low during a cooling process of an inside surface of the press-formed glass panel 100. The flow rates of the cooling air used for the cooling process of the inside surfaces of the face portion 101 and the skirt portion 102 can be independently controlled depending on types and sizes of the glass panel 100 for use in a CRT, a working environment, desired final residual stresses or the like.

In the second preferred embodiment of the present invention, an outside surface maximum compressive stress value σFCOmax and an inside surface maximum compressive stress value σFCImax near a center of the face portion 101 satisfy the relationship of $0.7 \leqq \sigma FCOmax/\sigma FCImax \leqq 1$.

Herein, the relationship of $\sigma FCOmax/\sigma FCImax \leqq 1$ means that the cooling and solidification process of the inside surface of the face portion 101 is carried out more quickly than that of the outside surface thereof. If the outside surface maximum compressive stress value σFCOmax is greater than the inside surface maximum compressive stress value σFCImax, i.e., $\sigma FCOmax > \sigma FCImax$, the outside surface of the face portion 101 is cooled and solidified more quickly than the inside surface thereof. That is, the amount of contraction of the inside surface of the face portion 101 is greater than that of the outside surface thereof. Electron beams from the electron gun installed at the neck 120 are irradiated on the inside surface of the face portion 101. Thus, if the contraction amount of the inside surface of the face portion 101 is great, display characteristics of the cathode ray tube 10 are deteriorated. On the other hand, if the outside surface maximum compressive stress value σFCOmax is less than or equal to the inside surface maximum compressive stress value σFCImax, i.e., $\sigma FCOmax \leqq \sigma FCImax$, the contraction amount of the outside surface of the face portion 101 is greater than that of the inside surface thereof. However, the outside surface of the face portion 101 can be polished by a following surface lapping and polishing process, so that the display characteristics of the cathode ray tube 10 can be maintained excellent.

In the glass panel 100 for use in a CRT in accordance with the second preferred embodiment of the present invention, after the inside surface thereof is cooled down by the cooling air during the forming process and stud pins are installed, the glass panel 100 is reheated in the annealing lehr and then cooled down to room temperature. When the glass panel 100 is cooled and solidified from a high temperature in the course of the aforementioned processes, compressive stress layers are formed on surfaces of the panel 100. In the second preferred embodiment of the present invention, in order to make the inside surface maximum compressive stress greater than the outside surface maximum compressive stress near the center of the face portion 101, the flow rate of the cooling air to be applied to the inside surface of the face portion 101 is increased during the press-forming process to increase the cooling rate of the inside surface of the face portion 101 in the mold. Further, in order to maintain the cooling rate of the skirt portion 102, the cooling rate of the skirt portion 102 can be controlled by varying currents of the cooling air. Consequently, the cooling rate of the inside surface of the face portion 101 in the mold increases. However, the outside surface of the face portion 101 is cooled and solidified with the mold. Accordingly, the cooling rate of the inside surface of the face portion 101 is greater than that of the outside surface thereof, and greater compressive stresses can be generated on the inside surface of the face portion 101.

In the meantime, if the outside surface maximum compressive stress value σFCOmax and the inside surface maximum compressive stress value σFCImax satisfy the relationship of $0.7 > \sigma FCOmax/\sigma FCImax$, i.e., $\sigma FCOmax < 0.7\sigma FCImax$, the compressive stress value generated on the outside surface of the face portion 101 is too small. Therefore, when a pressure-proof test of the cathode ray tube 10 is carried out, the glass panel 100 for use in a CRT can be easily broken due to defects formed on the outside surface of the face portion 101. In such case, the glass panel 100 for use in a CRT has a low breaking strength and, further, the life span of the cathode ray tube 10 is shortened.

Herein, the pressure-proof test has a purpose of predicting the life span of the cathode ray tube 10. To do so, a breaking pressure and a breaking point of the cathode ray tube 10 are examined by increasing an outside pressure of the cathode ray tube 10 while maintaining an interior pressure of the cathode ray tube 10 at a standard atmospheric pressure. In general, in a vacuum state, a maximum vacuum tensile stress is generated on the outside surface of the glass panel 100. Thus, if the aforementioned outside surface maximum compressive stress value σFCOmax exists on the outside surface compressive stress layer 10*a* of the panel 100, it is possible to obtain the cathode ray tube 10 whose breaking pressure is considerably increased compared to that of a cathode ray tube including a completely annealed panel.

In the second preferred embodiment of the present invention, if an outside surface compressive stress value σWO near the wedge portion 104 and the inside surface maximum compressive stress value σFCImax near the center of the face portion 101 satisfy the relationship of $0.4 \leqq \sigma WO/\sigma FCImax \leqq 1.3$, the deformation of the face portion 101 can be relatively reduced.

However, if they satisfy a relationship of $\sigma WO/\sigma FCImax < 0.4$ or $\sigma WO/\sigma FCImax > 1.3$, there exists big difference between the outside surface compressive stress value near the wedge portion 104 and that near the center of the face portion 101. Accordingly, the large deformation of the panel 100, such as a distortion or the like, occurs during the cooling and solidification process of the panel 100.

A further detailed description of the present invention will be provided by the following Experimental Examples. And description of what is known to those skilled in the art is omitted for simplicity.

Experimental Examples

Table 1 indicates the distribution of compressive stresses (unit: MPa) in the glass panels 100 for use in a CRT in accordance with the second preferred embodiment of the present invention. The glass panels 100 for use in a CRT used in these Experimental Examples 1 to 3 are for a 17-inch product in which an aspect ratio of an effective screen is 4:3. In the panels 100 of Experimental Examples 2 and 3, outside surfaces of their wedge portions 104 were cooled down at increased cooling rates to increase the values of σWO/σFCImax. At this time, a cooling air nozzle was used, which was capable of a partial control. The cooling rate of the wedge portion 104 in the panel used in Experimental Example 1 was less than those of Experimental Examples 2 and 3.

TABLE 1

| | Experimental Example 1 | Experimental Example 2 | Experimental Example 3 |
|---|---|---|---|
| Face portion maximum compressive stress (σFmax) | −25 | −25 | −28 |
| Skirt portion minimum compressive stress (σSmin) | −5 | −12 | −9 |
| σSmin/σFmax | 0.20 | 0.48 | 0.32 |
| Inside surface maximum compressive stress (σFCImax) near center of face portion | −25 | −25 | −23 |
| Outside surface maximum compressive stress (σFCOmax) near center of face portion | −20 | −23 | −20 |
| σFCOmax/σFCImax | 0.80 | 0.92 | 0.87 |
| Outside surface compressive stress value (σWO) near wedge portion | −12 | −25 | −28 |
| σWO/σFCImax | 0.48 | 1.00 | 1.22 |

TABLE 1-continued

| | Experimental Example 1 | Experimental Example 2 | Experimental Example 3 |
|---|---|---|---|
| Periphery variation (μm) | 43 | 50 | 47 |
| Inside surface shape variation (μm) | 33 | 31 | 36 |

Comparative Examples

Table 2 indicates the distribution of compressive stresses (unit: MPa) in glass panels for use in a CRT of a prior art. The glass panels used in these Comparative Examples 1 to 5 are for a 17-inch product in which an aspect ratio of an effective screen is 4:3. Different cooling conditions were applied to Comparative Examples 1 to 5 and Experimental Examples 1 to 3, while same experimental conditions in the annealing lehr were applied to them.

In Comparative Example 1, the press-formed glass panel was cooled down in a mold and, further, its face portion was not subjected to an additional cooling air process, so that its skirt portion could be cooled down more quickly than the face portion. Further, Comparative Example 2 offers a case where the inside surface of the panel is overly cooled down compared to the outside surface thereof during the cooling process in the mold. And Comparative Example 3 offers a case where the outside surface of the panel is cooled down more quickly than the inside surface thereof during the cooling process in the mold. Furthermore, in Comparative Example 4, the heat extraction rate of the mold was increased and, further, a partial cooling process for its wedge portion was added after the press forming process, thereby excessively increasing the cooling rate of the wedge portion. Moreover, in Comparative Example 5, the cooling rate of the face portion in the mold was increased compared to that of the skirt portion and, further, the cooling rate of the inside surface of the panel was increased by using the cooling air. However, after the press forming process had been completed, the outside surface of the wedge portion was not additionally cooled down.

TABLE 2

| | Comparative Ex. 1 | Comparative Ex. 2 | Comparative Ex. 3 | Comparative Ex. 4 | Comparative Ex. 5 |
|---|---|---|---|---|---|
| Face portion maximum compressive stress (σFmax) | −28 | −23 | −26 | −26 | −28 |
| Skirt portion minimum compressive stress (σSmin) | −16 | −14 | −17 | −16 | −15 |
| σSmin/σFmax | 0.57 | 0.61 | 0.65 | 0.62 | 0.54 |
| Inside surface maximum compressive stress (σFCImax) near center of face portion | −24 | −23 | −21 | −21 | −28 |
| Outside surface maximum compressive stress (σFCOmax) near center of face portion | −28 | −15 | −26 | −26 | −21 |
| σFCOmax/σFCImax | 1.17 | 0.65 | 1.24 | 1.24 | 0.75 |
| Outside surface compressive stress value (σWO) near wedge portion | −11.1 | −8.5 | −17 | −28 | −10 |
| σWO/σFCImax | 0.46 | 0.37 | 0.81 | 1.33 | 0.36 |
| Periphery variation (μm) | 81 | 67 | 74 | 68 | 64 |
| Inside surface shape variation (μm) | 96 | 86 | 91 | 84 | 77 |

In Tables 1 and 2, the compressive stresses were measured by a polariscope based on Senarmont method employing photoelasticity prescribed in JIS(Japanese Industrial Standard)-S2305 after the panels were cut into a cross section. At this time, as a measurement sample, the face portion was cut into about 10 mm in width×(100-120) mm in length for a measurement in a random direction near the center. Furthermore, the residual stresses of the wedge portion and the skirt portion were measured on the cross section of the panel like the panel 100 shown in FIG. 2 by processing a portion containing the wedge portion and the skirt portion into a width of about 10 mm.

In addition, the periphery variation in Tables 1 and 2 indicates a variation in the seal edge, i.e., a connection portion of the panel to the funnel illustrated in FIG. 1. Besides, the inside surface shape variation indicates a vertical variation obtained by comparing sizes of the inside surface of the glass panel, which has been subjected to the stud pin installing process and then has passed the annealing lehr, with design values in drawings. In other words, the inside surface shape variation is a height difference between a design reference value for height and a measured value for height at a center of the glass panel from a surface of the face portion to two diagonal lines connecting four corners of the rear end of the skirt portion. As the inside surface shape variation increases, the product shape becomes more deformed.

As depicted in Table 1, in Experimental Examples 1 to 3 in accordance with the second preferred embodiment of the present invention, the maximum compressive stress value σFmax and the minimum compressive stress value σSmin satisfy the relationship of $\sigma Smin/\sigma Fmax \leqq 0.5$; the outside surface maximum compressive stress value σFCOmax and the inside surface maximum compressive stress value σFCImax near the center of the face portion 101 satisfy the relationship of $0.7 \leqq \sigma FCOmax/\sigma FCImax \leqq 1$; and the outside surface compressive stress value σWO near the wedge portion 104 and the inside surface maximum compressive stress value σFCImax near the center of the face portion 101 satisfy the relationship of $0.4 \leqq \sigma WO/\sigma FCImax \rightarrow 1.3$. The periphery variation and the inside surface shape variation of Experimental Examples 1 to 3 indicated in Table 1 are phenomenally less than those of Comparative Examples 1 to 5 shown in Table 2.

Hereinafter, characteristics of the cathode ray tube in accordance with the first preferred embodiment of the present invention will be described by comparing Experimental Examples 1 to 3 with Comparative Examples 1 to 5 with reference to Tables 1 and 2.

In Comparative Examples 1 to 5 depicted in Table 2, the ratio of σSmin to σFmax is greater than 0.5. And, the periphery and the inside surface shape of each Comparative Example are considerably changed compared to those of Experimental Examples 1 to 3. Thus, Comparative Examples 1 to 5 have inferior characteristics compared to Experimental Examples 1 to 3.

Further, in Comparative Examples 1 to 4, the ratio of σFCOmax to σFCImax is less than 0.7 or greater than 1. And the periphery and the inside surface shape of each Comparative Example are considerably changed compared to those of Experimental Examples 1 to 3. Thus, Comparative Examples 1 to 4 have inferior characteristics to Experimental Examples 1 to 3.

Furthermore, in Comparative Examples 2, 4 and 5, the ratio of σWO to σFCImax is less than 0.4 or greater than 1.3. And, the periphery and the inside surface shape of each Comparative Example are considerably changed compared to those of Experimental Examples 1 to 3. Thus, Comparative Examples 2, 4 and 5 have inferior characteristics compared to Experimental Examples 1 to 3.

As described above, in accordance with the glass panel for use in a CRT of the present invention and the cathode ray tube including the same, it is possible to relatively reduce the deformation of the face portion of the panel and improve characteristics of a screen portion of the cathode ray tube by improving the distribution of the compressive stresses while performing a physical strengthening process. Especially, the accuracy of curvatures of the face portion and the quality of a periphery of the seal edge of the face portion can be considerably improved.

While the invention has been shown and described with respect to the preferred embodiments, it will be understood by those skilled in the art that various changes and modification may be made without departing from the spirit and scope of the invention as defined in the following claims.

What is claimed is:

1. A glass panel for use in a cathode ray tube, comprising:

a face portion for displaying images;

a skirt portion extending from a periphery of the face portion backwards; and a blend radius portion for connecting the face portion and the skirt portion, wherein the face portion includes an effective screen and a wedge portion positioned near a periphery portion of the effective screen, and compressive stress layers are formed on any regions of an inside and an outside surface of the face portion and the skirt portion, and a maximum compressive stress value σFmax of the face portion and a minimum compressive stress value σSmin of the skirt portion satisfy a relationship of $\sigma Smin/\sigma Fmax < 0.5$, and wherein an outside surface compressive stress value σWO near the wedge portion and an inside surface maximum compressive stress value σFCImax near the center of the face portion satisfy a relationship of $0.4 \leqq \sigma WO/\sigma FCImax \leqq 1.3$.

2. The glass panel of claim 1, wherein an outside surface maximum compressive stress value σFCOmax and an inside surface maximum compressive stress value σFCImax near a center of the face portion satisfy a relationship of $0.7 \leqq \sigma FCOmax/\sigma FCImax \leqq 1$.

3. A cathode ray tube comprising the glass panel of claim 1.

4. A cathode ray tube comprising the glass panel of claim 2.

* * * * *